US005727466A

United States Patent [19]

Greive et al.

[11] Patent Number: 5,727,466

[45] Date of Patent: Mar. 17, 1998

[54] METHOD AND DEVICE FOR HOLDING SUBSTRATES ON A TRANSPORT BELT OF A PRINTING PRESS

[75] Inventors: Martin Greive, Heidelberg; Anton Rodi, Leimen, both of Germany

[73] Assignee: Heidelberger Druckmasinen AG, Heidelberg, Germany

[21] Appl. No.: 769,397

[22] Filed: Dec. 19, 1996

[30] Foreign Application Priority Data

Dec. 18, 1995 [DE] Germany ..... 195 47 087.7
Apr. 15, 1996 [DE] Germany ..... 196 14 717.4

[51] Int. Cl.[6] ..... B41F 13/24

[52] U.S. Cl. ..... 101/232; 271/900

[58] Field of Search ..... 101/231, 232, 101/407.1, 419, 212, 216; 271/900, 18, 34

[56] References Cited

U.S. PATENT DOCUMENTS

| | | | |
|---|---|---|---|
| 162,892 | 5/1875 | Braidwood | 271/900 |
| 3,554,124 | 1/1971 | McIntire . | |
| 3,695,756 | 10/1972 | Smith | 271/900 |
| 4,072,307 | 2/1978 | Knieser | 271/900 |
| 4,156,524 | 5/1979 | Bar-on et al. | 271/900 |
| 4,386,845 | 6/1983 | Miyoshi et al. . | |
| 4,411,511 | 10/1983 | Ariyama et al. | 271/900 |
| 4,511,238 | 4/1985 | Hori . | |
| 4,752,811 | 6/1988 | Takayashi . | |
| 4,806,985 | 2/1989 | Foley et al. . | |
| 5,217,220 | 6/1993 | Carlson et al. | 371/900 |
| 5,244,294 | 9/1993 | Ewing | 400/625 |
| 5,333,545 | 8/1994 | Ganter et al. . | |
| 5,517,292 | 5/1996 | Yajima | 271/900 |

FOREIGN PATENT DOCUMENTS

| | | | |
|---|---|---|---|
| 0 297 227 A2 | 1/1989 | European Pat. Off. . | |
| 958832 | 3/1950 | France | 271/900 |
| 19 69 625 | 8/1970 | Germany . | |
| 22 22 978 | 11/1972 | Germany . | |
| 30 23 996 A1 | 1/1982 | Germany . | |
| 31 08 340 C2 | 1/1982 | Germany . | |
| 37 36 369 A1 | 5/1988 | Germany . | |
| 41 13 362 C2 | 11/1991 | Germany . | |
| 55-48769 | 4/1980 | Japan . | |
| 162769 | 12/1981 | Japan . | |
| 57-176076 | 10/1982 | Japan . | |
| 58-72176 | 4/1983 | Japan . | |
| 61-59376 | 3/1986 | Japan . | |
| 63-234276 | 9/1988 | Japan . | |
| 5-338855 | 12/1993 | Japan . | |
| 7-68742 | 3/1995 | Japan . | |

OTHER PUBLICATIONS

"Paper Stripping Mechanism" IBM Technical Disclosure Bulletin, vol. 12, No. 11, pp. 18 33, Apr. 1970.

*Primary Examiner*—Eugene H. Eickholt
*Attorney, Agent, or Firm*—Herbert L. Lerner; Laurence A. Greenberg

[57] ABSTRACT

A device for holding substrates on a printing-press transport belt successively transporting the substrates closely past an impression cylinder includes at least one stripping device disposed in an exit part of a nip between the impression cylinder and the transport belt, the at least one stripping device being movable in synchronism with a printing-press cycle towards and away from the impression cylinder; and a method of operating the device.

4 Claims, 4 Drawing Sheets

METHOD AND DEVICE FOR HOLDING SUBSTRATES ON A TRANSPORT BELT OF A PRINTING PRESS

BACKGROUND OF THE INVENTION

1. Field of the Invention

The invention relates to a method and a device for holding substrates on a transport belt of a printing press. For transporting substrates to be printed, such as paper sheets or foils, past individual impression cylinders of a printing press, several more recent printing presses employ, instead of chains and grippers, an endless transport belt whereon the substrates lie. The impression cylinders are disposed adjoining the transport belt, and when the substrates pass in succession between the impression cylinders and the transport belt, the ink is transferred from the impression cylinders onto the substrates.

For fixedly holding the substrates on the transport belt, electrostatic holding devices are provided, such as are described, for example, in U.S. Pat. No. 4,244,465 or in the published European Patent Document 02 97 227 A, the electrostatic holding devices producing electrostatic holding forces which fixedly hold the substrates by the entire surface area thereof on the transport belt. Alternatively, for example, corresponding holding forces can also be produced by sucking or suction-gripping the substrates from the transport belt.

It has been found, however, that substrates held in such a manner may, under certain circumstances, continue to adhere to an impression cylinder as they pass the printing gap or nip between the impression cylinder and the transport belt, and may be loosened or come away from the transport belt. This tendency exists particularly when the printing ink is not completely transferred and when ink residues remain on the impression cylinder, after the substrates have passed the printing gap or nip.

SUMMARY OF THE INVENTION

It is accordingly an object of the invention to provide a method and a device for holding substrates on a transport belt, more particularly, as they pass a printing gap or nip between an impression cylinder and the transport belt, the method and the device being reliable for avoiding continued adhesion of the substrates to the impression cylinder after they have passed the printing gap or nip.

With the foregoing and other objects in view, there is provided, in accordance with one aspect of the invention, a method of holding substrates on a printing-press transport belt for successively transporting the substrates closely past an impression cylinder, which comprises disposing at least one stripping device in an exit part of a nip between the impression cylinder and the transport belt, moving the at least one stripping device in synchronism with a printing-press cycle against and away from the surface of the impression cylinder, which includes moving the at least one stripping device against the surface of the impression cylinder before a leading edge of a substrate adhering to the impression cylinder arrives at the stripping device, and moving the at least one stripping device away again from the surface of the impression cylinder before a leading edge of the printed region on the substrate arrives at the stripping device.

In accordance with another aspect of the invention, there is provided a device for holding substrates on a printing-press transport belt successively transporting the substrates closely past an impression cylinder, comprising at least one stripping device disposed in an exit part of a nip between the impression cylinder and the transport belt, the at least one stripping device being movable in synchronism with a printing-press cycle towards and away from the impression cylinder.

In accordance with a further feature of the invention, the at least one stripping device has an elongated stripping element extending parallel to the axis of the impression cylinder across the entire width of the impression cylinder.

In accordance with an added feature of the invention, the elongated stripping element is of such form as to initially strip away corners of a substrate adhering to the impression cylinder.

In accordance with an additional feature of the invention, the elongated stripping element is formed by one of a thin blade and a thin wire, and including two clamping devices, respectively, disposed at a side of the impression cylinder and being movable in a direction towards and away from the impression cylinder, the two clamping devices, respectively, holding the elongated element in tension.

In accordance with yet another feature of the invention, the substrate-holding device includes a supply reel for the elongated stripping element, the elongated stripping element, starting from said supply reel, extending through one of the two clamping devices to the other of the two clamping devices.

In accordance with a further aspect of the invention, there is provided a device for holding substrates on a printing-press transport belt for successively transporting the substrates closely past an impression cylinder, comprising a stripping device disposed in an exit part of a nip between the impression cylinder and the transport belt, the stripping device extending substantially across the width of the impression cylinder and being formed so that corners of a substrate adhering to the impression cylinder are initially strippable away from the impression cylinder.

In accordance with another feature of the invention, the stripping device has a tapered edge directed at an inclination to the surface of the impression cylinder, the edge being substantially concave in form along the length thereof, and adjoining the surface of the impression cylinder substantially over the entire length thereof.

In accordance with an added aspect of the invention, there is provided a device for holding substrates on a printing-press transport belt for transporting successive substrates closely past an impression cylinder, comprising a respective stripping element disposed at each side of the impression cylinder in an exit part of a nip between the impression cylinder and the transport belt, the stripping element having a tapered edge directed at an inclination towards the surface of the impression cylinder and, in a region of an image-free side margin of the substrates, adjoining the surface of the impression cylinder.

In accordance with a further feature of the invention, the stripping device has a surface which is situated opposite the transport belt and over which a just-stripped leading edge of a substrate passes, the surface being concavely arched in transport direction of the substrates.

In accordance with an added feature of the invention, the stripping elements, respectively, have a surface which is situated opposite the transport belt and over which a just-stripped leading edge of a substrate passes, the surface being concavely arched in transport direction of the substrates.

In accordance with an additional aspect of the invention, there is provided a device for holding substrates on a printing-press transport belt for transporting successive substrates closely past an impression cylinder, comprising a stripping device disposed in an exit part of a nip between the impression cylinder and the transport belt, the stripping device extending substantially across the width of the impression cylinder and being of such form that a corner of a substrate adhering to the impression cylinder is initially strippable from the impression cylinder.

In accordance with another feature of the invention, the stripping device has a guide surface for guiding the stripped away leading edge of the substrate from the transport belt so that the freshly printed substrate avoids contact with the guide surface.

In accordance with a further feature of the invention, the substrate-holding device includes rollers, through the intermediary of which the substrate is guidable, after it has been stripped away from the impression cylinder by the stripping device, for supplying the substrate to the transport belt.

In accordance with a concomitant feature of the invention, a corner of the stripping device initially stripping the substrate away from the impression cylinder engages in a groove formed on the surface of the impression cylinder.

The invention is thus based on the realization that the aforementioned problems are caused by the insufficient adhesion of the leading edge of a substrate to the transport belt. The reason for this insufficient adhesion is that the aforementioned holding forces are less effective at the edges of the substrate. If success is achieved in holding the leading edge of the substrate on the transport belt or in stopping it from starting to come away from the transport belt, it can thus be expected that the following part of the substrate will remain on the transport belt.

According to the invention, there are a plurality of different possibilities for stopping the substrate from coming away from the transport belt without the risk of damaging the freshly printed image.

A first possibility lies in dynamic blade action in the exit part of the nip or gap for the substrates between the impression cylinder and the transport belt. A stripping device disposed in the exit part of the nip for stripping off a substrate which has adhered to the impression cylinder is movable towards and away from the impression cylinder and is moved towards the impression cylinder whenever the leading edge of a substrate passes the printing nip. If the substrate has adhered to the impression cylinder, the image-free leading edge is stripped off and is thereafter again held on the transport belt. The stripping device is moved away again from the impression cylinder, before the end of the image-free region at the front on the substrate has been reached.

The stripping device may have one or more movable blades disposed one behind the other along the width of the substrate, the movable blades, respectively, having a tapered edge extending parallel to the axis of the impression cylinder and being directed obliquely or at an inclination to the surface of the impression cylinder. The blade or blades may be formed or disposed in such a manner that the corners of a substrate are stripped off initially. The initially released parts of the substrate support the further release thereof along the leading edge of the substrate.

If a single elongated element is used as a blade, the element may be formed by a thin sheet or foil or by a thin wire, the thin sheet, foil or wire being held in tension between two clamping devices, the clamping devices, respectively, being disposed at one side of the impression cylinder or transport belt and being movable towards and away from the impression cylinder.

The sheet, foil or wire may be wound on a supply reel laterally on the printing press, the sheet, foil or wire extending through one of the clamping devices to the other clamping device. When the wire or the leading edge of the sheet or foil between the clamping devices has worn out, the wire, foil or sheet is replaced from the supply reel. This is considerably faster and more economical to perform than the re-grinding of conventional blades.

The sheet, foil or wire may be formed of any material which is of sufficient tensile strength and durability, e.g., a leaf spring or a steel wire. A given spring deflection of the sheet, foil or wire when it is being moved towards the impression cylinder may be desired in order, also with this embodiment, to ensure that the leading edge of the substrate is not abruptly stripped off, but rather, is stripped off steadily starting from the corners.

A second possibility for stopping a substrate from coming away from the transport belt without the risk of damaging the freshly printed image lies in a fixed stripping device being disposed in the exit part of the printing nip between the impression cylinder and the transport belt, the stripping device extending substantially across the width of the impression cylinder. The stripping device is formed so that the corners of a substrate adhering to the impression cylinder are stripped off initially.

The initially stripped-off corners are able to be held once again on the transport belt and thereby support the further release of the substrate towards the center of the stripping device. This makes it possible to ensure that the sheet quickly comes away completely from the impression cylinder and, as a whole, is returned to the transport belt before the stripping edge of the stripping device is able to contact the printed region on the substrate.

A surface of the stripping device, which is situated opposite the transport belt and over which a just-stripped leading edge of a substrate passes, is preferably concavely arched in the transport direction of the substrates. A just-stripped leading edge of a substrate follows this curvature, as a result of which it is steadily deflected towards the transport belt. The leading edge of the substrate is therefore again purposefully accelerated in a direction towards the transport belt, as a result of which it is able once again to effect a hold thereon even faster.

The stripping-off of the substrates starting from the corners has the added advantage that delicate substrates cannot be damaged in the process. Namely, it has been found that, at high transport speeds, substrates tend to tear if the stripping-off operation is begun from anywhere else but the corners, such as, for example, from the center.

In order to permit the stripping-off operation to start at the corners of the substrates, the edge of the stripping device which adjoins the impression cylinder is preferably slightly concave in form along the length thereof. This has the advantage that, regardless of the size of the just-printed substrates, the stripping-off operation always starts at the corners and is propagated towards the center of the substrates.

A further advantageous embodiment, which permits stripping independently of sheet size or format, is produced if one corner of the stripping device is nearer to the impression cylinder than the other corner. The corner nearer to the impression cylinder can then be selected as the reference corner for the alignment of different sizes or formats of paper. The corner serving as the reference corner will always start initially with the release of the substrate from the impression cylinder.

In a further embodiment, the corner of the stripping device nearer to the impression cylinder is caused to engage in a groove formed in the surface of the impression cylinder.

In an advantageous manner, the substrate is thereby permitted to be stripped from the impression cylinder without it being necessary for the stripping device to contact the impression cylinder.

In order to prevent smearing of the freshly printed sheet during the stripping operation, the paper sheet, which has been released from the impression cylinder, is returned to the transport belt via a roller arrangement which, in an advantageous manner counteracts smearing. Furthermore, smearing can be prevented by providing the stripping device with a guide surface for guiding the stripped-off leading edge of the substrate to the transport belt so that the freshly printed substrate does not contact the guide surface.

The stripping device does not have to be a single continuous element, but may be assembled along the length thereof of a plurality of individual elements, with straight or slightly curved stripping edges, the overall result being a stripping device with a concavely formed stripping edge.

In the event that the stripping device is composed of a plurality of individual stripping elements, it is not disadvantageous if the individual stripping elements do not adjoin one another without any gap therebetween because, once started, the stripping operation is propagated across any gaps between the individual stripping elements due to the inherent stiffness of the substrates.

Because of the inherent stiffness of the substrates, it may be sufficient to employ two relatively narrow stripping elements, which are active only in the region of image-free side margins of the substrates. The stripping elements engage the leading corners of a substrate adhering to the impression cylinder and initially strip off only the corners. Because the front or leading margin of the substrate is likewise image-free and adheres less strongly to the impression cylinder than the printed regions, the releasing operation is then propagated along the leading edge of the substrate. The stripped-off corners and the subsequently released leading edge are then able again to be held on the transport belt, and ensure that the following part of the substrate is also returned to the transport belt or, indeed, does not leave it in the first place.

Unlike the two aforedescribed possibilities, however, this third possibility for stopping a substrate coming away from the transport belt without the risk of damaging the freshly printed image requires that the substrates have image-free side margins. Furthermore, in order to adapt to substrates of different widths, the two individual stripping elements must be laterally adjustable.

Other features which are considered as characteristic for the invention are set forth in the appended claims.

Although the invention is illustrated and described herein as embodied in a method and a device for holding substrates on a transport belt of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
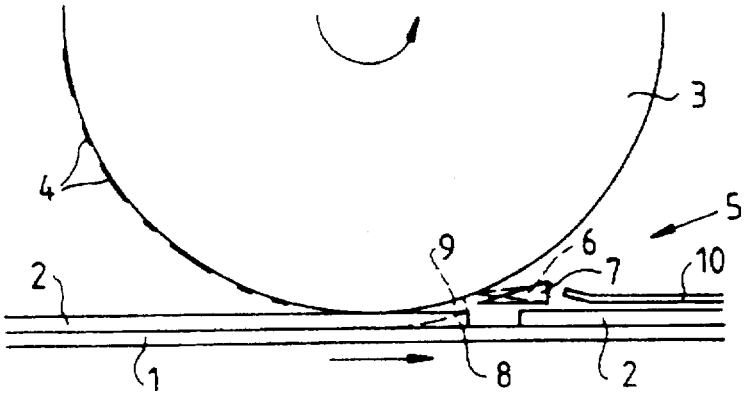
FIG. 1 is a fragmentary, diagrammatic cross-sectional view of a sheet-fed printing press with a wedge-shaped sheet stripper located between an impression cylinder and a transport belt and forming part of the device of the invention of the instant application.

Referring now to the drawings and, first, particularly to FIG. 1 thereof, there is shown therein a sheet-fed printing press having a transport belt 1 carrying substrates or sheets 2 to be printed, the substrates or sheets 2 being conveyed in succession from the left-hand to the right-hand side of the figure in a direction represented by the horizontal arrow. The sheets 2 are fixedly held on the transport belt 1, for example, by means of electrostatic holding forces generated by non-illustrated conventional means.

Shown above the transport belt 1 is an impression cylinder 3, which may be a form cylinder of a conventional printing unit, or a transfer cylinder of a digital printing unit. During operation, the impression cylinder 3 rotates in the direction represented by the curved arrow, the outer cylindrical surface of the impression cylinder 3 moving at the same speed as the transport belt 1, and conveying printing ink 4 in a distribution corresponding to a desired printing image into a printing gap or nip 5 between the impression cylinder 3 and the transport belt 1. The impression cylinder 3 presses against the sheet 2 which is then in the printing gap or nip 5, and transfers the printing ink 4 onto the sheet 2.

A sheet stripper 6 is disposed in an exit or outlet part of the nip or gap 5 between the impression cylinder 3 and the transport belt 1, i.e., in a region to the right-hand side of a location at which the impression cylinder 3 and the transport belt 1 are closest to one another. The sheet stripper 6 is an elongated component or element extending axially parallel to the impression cylinder 3 across the entire printing width and having a wedge-shaped cross section. The sheet stripper 6 is supported on the printing press so as to be swivellable about an axis 7 extending parallel to the axis of the impression cylinder 3.

A non-illustrated conventional driving device is provided for swiveling the sheet stripper 6 from a rest position thereof represented by solid lines into a position thereof represented by broken lines, and back again to the rest position thereof. In the position represented by the broken lines, the tip of the sheet stripper 6 contacts the impression cylinder 3 along a straight or rectilinear line extending in axial direction along the surface of the impression cylinder 3, the tip of the sheet stripper 6 being directed obliquely, i.e., at an inclination, to the surface of the impression cylinder 3. In the rest position of the sheet stripper 6, there is a space between the tip of the sheet stripper 6 and the surface of the impression cylinder 1. The sheet stripper 6 is constructed and disposed so that, while the tip thereof projects as far as possible into the exit part of the gap or nip 5, it is still free to swivel between the two positions shown. It is expected that an up and down travel movement of the tip of the sheet stripper 6 of approx. 0.5 mm will be sufficient, so that the sheet stripper 6 can be disposed very close to the printing gap or nip 5.

Instead of being set up for a rotary movement, the sheet stripper 6 may be set up for any other suitable movement towards the surface of the impression cylinder 3 and away therefrom, such as for a parallel displacement, for example.

Every time when, during operation, a leading edge 8 of a sheet 2 enters the printing gap or nip 5 between the impression cylinder 3 and the transport belt 1, the sheet stripper 6 is brought from the rest position thereof into the position thereof represented by the broken lines. The tip of the sheet stripper 6 must either be in contact with the impression cylinder 3 or be very close thereto before it is reached by the leading edge 9 (represented by dotted lines) of a sheet 2 adhering to the impression cylinder 3.

The sheet stripper 6 strips off the leading edge 9 of the adhering sheet 2, the underside of the sheet stripper 6 deflecting the leading edge 9 of the sheet 8 towards the transport belt 1. The sheet stripper 6 is swiveled back again into the rest position thereof, even before the tip thereof has reached the end of the image-free or print-free region at the front of the sheet 2. This swiveling movement return additionally accelerates the released part of the sheet 2 towards the transport belt 1, so that, thereafter, the sheet 2 is able once again to be held on the transport belt 1 if the print-free or image-free region is very narrow and the cycle time, during which the sheet stripper 6 engages the impression cylinder 3, is very brief.

If the possibility cannot safely be ruled out that a release of the sheet from the impression cylinder 3 may take place in the region between the sheet stripper 6 and a following station of the printing press, it is possible for a sheet down-holder 10 to be disposed behind the sheet stripper 6.

Instead of one elongated sheet stripper 6, it is also possible to dispose a plurality of individual sheet strippers in a row.

Figure 2:
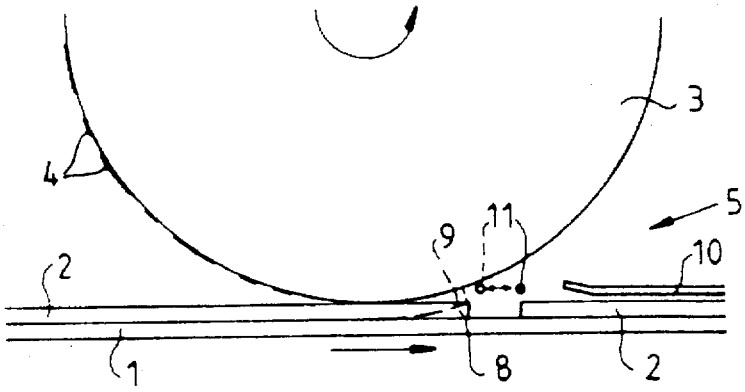
FIG. 2 is a view like that of FIG. 1 of another embodiment of the inventive device, wherein a wire-shaped sheet stripper is disposed between an impression cylinder and a transport belt.
Figure 3:
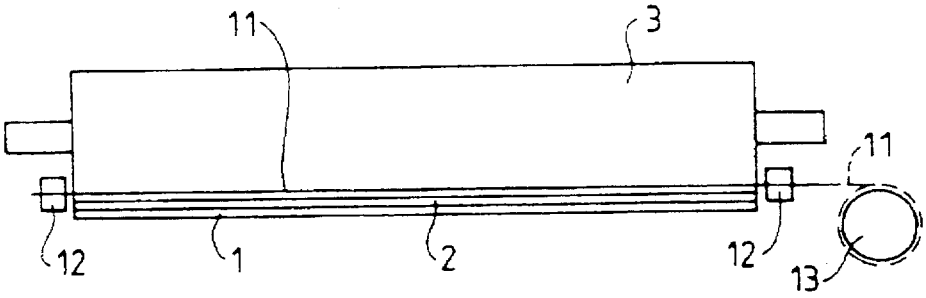
FIG. 3 is a reduced top plan view of FIG. 2 showing the exit or outlet part of the gap or nip formed between the impression cylinder and the transport belt.

Another embodiment of the device according to the invention is shown in FIGS. 2 and 3, wherein identical components of the embodiment of FIG. 1 are identified by like reference numerals. FIG. 3 shows the device of FIG. 2 as viewed from the right-hand side, i.e., looking into the exit part of the gap or nip 5, with the sheet stripper 10 being omitted.

The embodiment in FIGS. 2 and 3 differs from that of FIG. 1 in that, instead of a wedge-shaped sheet stripper 6, there is provided a thin steel wire 11, which is clamped on both sides of the printing press in clamping devices 12 between which it is held in tension. The clamping devices 12 are connected to a non-illustrated drive by which they are able to be moved together towards the impression cylinder 3 and away therefrom. In conformity with this movement, the steel wire 11 is movable between the two positions shown in FIG. 2, for example along the double-headed arrow. The operation of this embodiment of FIGS. 2 and 3 is identical with the operation of the embodiment shown in FIG. 1, i.e. a cyclic movement of the steel wire 11 in synchronism with the transport of the sheets occurs.

The steel wire 11 must be thin enough to be able to release an adhering sheet 2 from the impression cylinder 3, i.e., it must be approximately as thin as the sheet 2 or thinner.

To obviate the need for any time-consuming and costly assembly and disassembly operations as a result of ravages of wear and tear on the steel wire 11, a supply reel 13 may be mounted on the printing press at the side of one of the clamping devices 12, a supply of the steel wire 11 being wound on the supply reel 13, as represented by broken lines in FIG. 3. When the piece of steel wire 11 held in tension between the clamping devices 12 has become worn, the steel wire 11 is simply pulled through to the left-hand side, as viewed in FIG. 3, and replaced by wire from the supply reel 13. The steel wire 11 runs, for example, through thin holes in the clamping devices 12, so that the wire 11 can be replaced without having to realign the clamping devices 12.

In a further embodiment not otherwise shown in detail, the steel wire 11 is replaced by an elongated thin leaf or blade of spring steel having a leading edge which is disposed in a manner similar to the steel wire 11 in FIG. 2 and is movable against the impression cylinder 3. This spring steel leaf or blade may likewise be replenished from a supply reel in the manner shown in FIG. 3.

Figure 4:
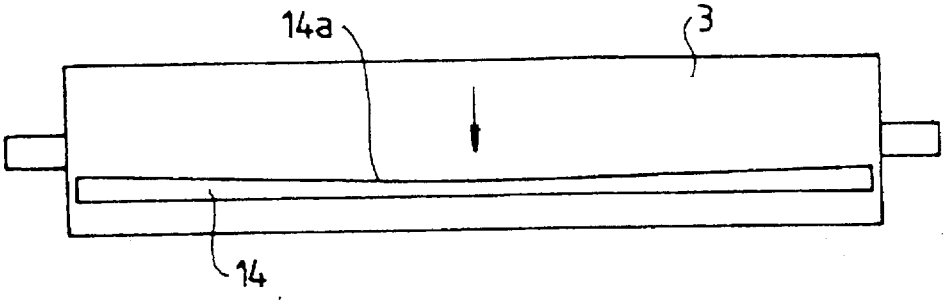
FIG. 4 is a bottom plan view, rotated 90° clockwise, of FIG. 1, with the transport belt and printing sheet removed, of a further embodiment of the device according to the invention, wherein the sheet stripper has a concavely curved stripping edge.
Figure 5:
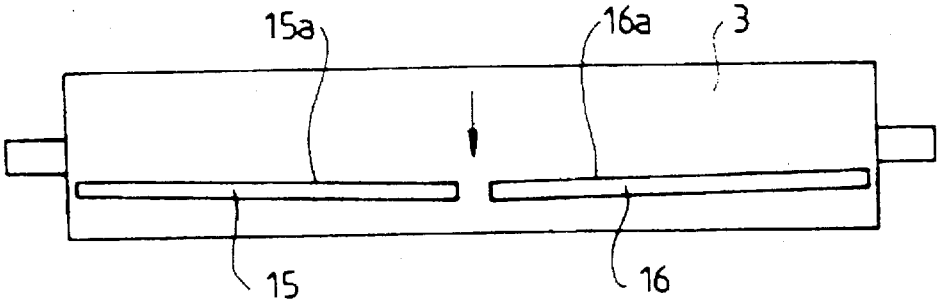
FIG. 5 is a view like that of FIG. 4 of an added embodiment of the device according to the invention, which has two rectilinear or straight sheet strippers disposed at an angle to one another.
Figure 6:
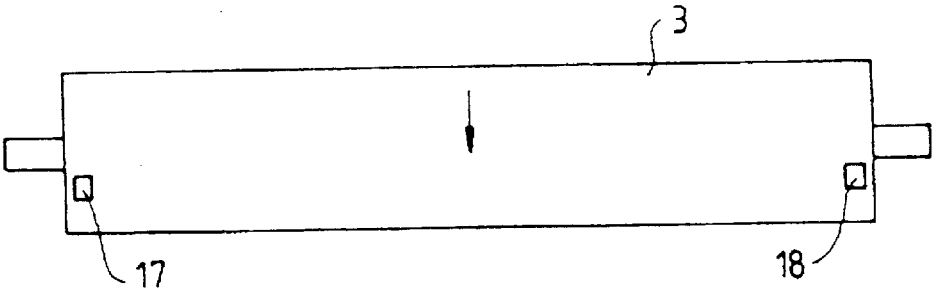
FIG. 6 is a view like that of FIGS. 4 and 5 of an additional embodiment of the device according to the invention, wherein respective narrow sheet strippers are disposed at the respective ends of an impression cylinder.

Whereas, in the aforedescribed embodiments, the sheet stripper is movable, a plurality of embodiments with fixed sheet strippers are illustrated in FIGS. 4 to 6, which correspond in substance to a bottom plan view, rotated 90° clockwise, of the embodiment shown in FIG. 1, with the transport belt 1 and the sheet 2 removed. Instead of the sheet stripper 6 of FIG. 1, which is movable towards the impression cylinder 3 and away therefrom, there are substituted in FIGS. 4 to 6, a variety of specially shaped sheet strippers which are in constant contact with the impression cylinder 3. The respective arrows shown in FIGS. 4 to 6 represent the direction of rotational movement of the surface of the impression cylinder 3.

A sheet stripper 14 shown in FIG. 4 has a slightly concavely curved stripping edge **14*a* which, beginning with the corners of a sheet adhering to the impression cylinder 3, releases the sheet from the impression cylinder 3. The releasing action is steadily propagated along the leading edge of the sheet towards the center of the sheet. The parts of the sheet which have already been released are able to regain contact with the transport belt and to be held thereon, thereby supporting or assisting the further releasing action. Due to the fluid releasing action and the support thereof by the previously released parts of the sheet, the release of the sheet from the impression cylinder 3 occurs with such speed and reliability that the sheet has, to a great extent, regained contact with the transport belt before the printed region on the sheet reaches the stripping edge 14*a* of the sheet stripper 14. The holding forces of the transport belt then quickly and completely draw the sheet back again to the transport belt. Therefore, no risk exists that the freshly printed image on the sheet will be damaged by the sheet stripper 14, which is in continuous contact with the impression cylinder 3**.

A concavely formed stripping edge is also able to be realized by a plurality of individual sheet strippers which are suitably disposed in a row. An example thereof is shown in FIG. 5, wherein there are provided two straight sheet strippers 15 and 16, which are each slightly less than half the length of the impression cylinder 3 and disposed in a juxtaposed manner.

The stripping edges 15*a* and 16*a* of the respective sheet strippers 15 and 16, each of which are of rectilinear construction, mutually intersect at a small angle, so that an assembled concave stripping edge is formed.

The sheet strippers shown in FIGS. 4 and 5 do not need to be readjusted when there is a change in sheet size or format.

In the aforedescribed embodiments, the image-free or print-free front or leading sheet margin was used in order to return again to the transport belt a sheet adhering to the impression cylinder. These embodiments thus also function if the sheets are completely printed in the lateral direction, i.e. if they have no image-free or print-free side margins.

Should the sheets have image-free or print-free side margins, the embodiment shown in FIG. 6 additionally enters into consideration. As shown in FIG. 6, a narrow sheet stripper 17, 18 is disposed at each end of the impression cylinder 3, more specifically in the region of the image-free or print-free side margins. The sheet strippers 17 and 18 directly strip off only the image-free or print-free side margins of a sheet, so that there is no risk whatsoever that the freshly printed image on the sheet will be damaged, although the sheet strippers 17 and 18 are in continuous contact with the impression cylinder 3. The releasing action initiated at the corners is propagated along the leading edge of the sheet and results in the sheet completely regaining contact with the transport belt, supported, where appropriate, by a sheet down-holder, as shown in FIGS. 1 and 2.

The embodiments shown in FIGS. 1 to 3, which relate to movable sheet strippers, and the embodiments shown in FIGS. 4 to 6, which relate to concave or concavely disposed sheet strippers, may also be combined in an advantageous manner. For example, through a suitable arrangement or cycling of a plurality of movable sheet strippers, additional assurance may be provided that a sheet 2 adhering to the impression cylinder 3 will be released initially at the corners thereof.

Figure 7:
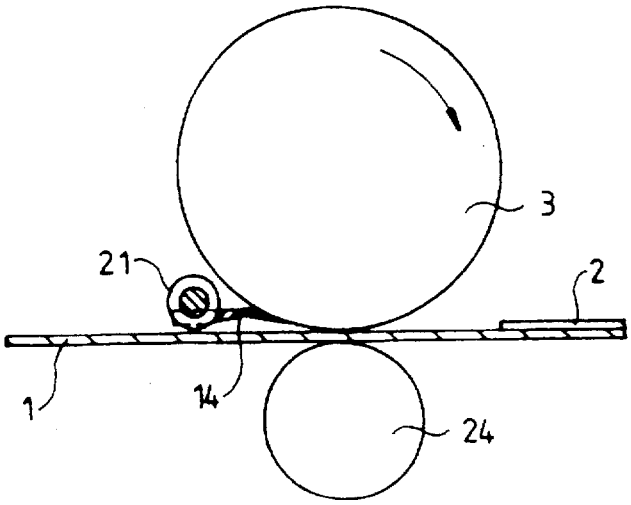
FIG. 7 is a side elevational view of the device according to the invention, showing the arrangement of the stripping device with respect to the impression cylinder and the transport belt carrying a substrate.
Figure 8:
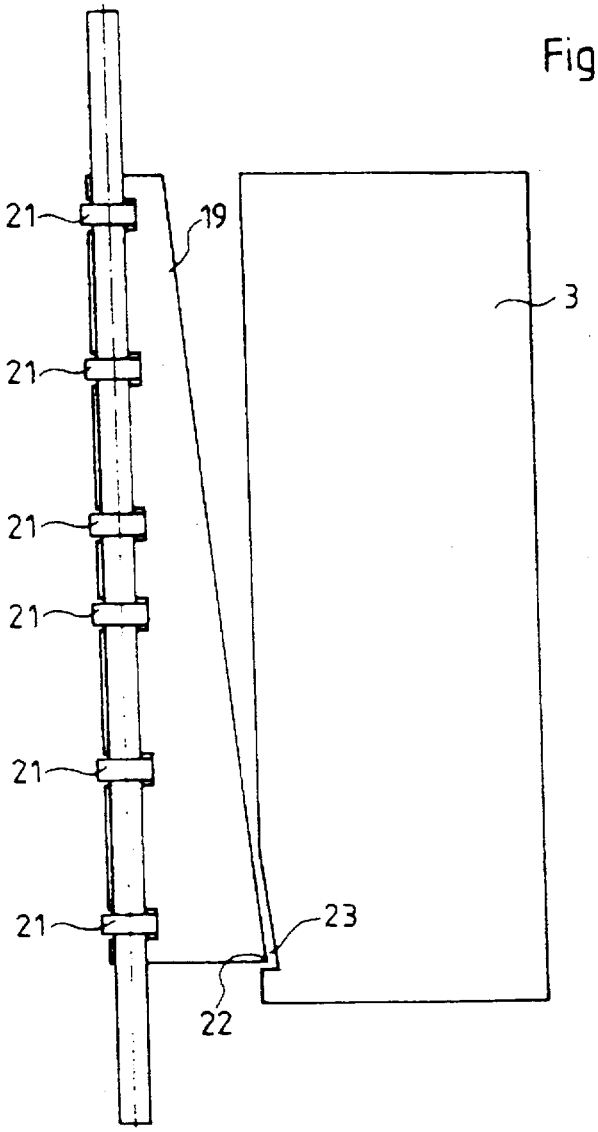
FIG. 8 is a top plan view of FIG. 7.
Figure 9:
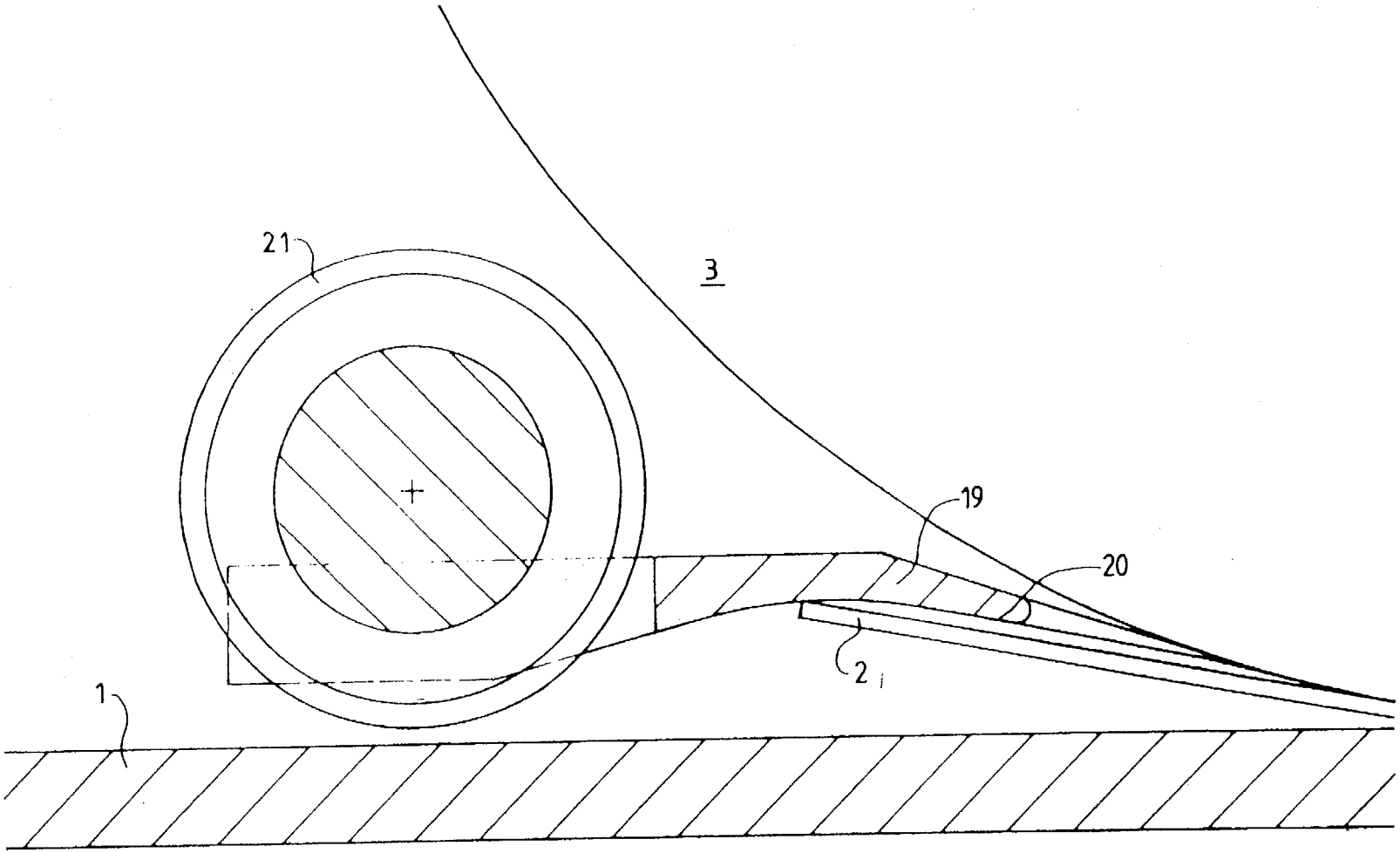
FIG. 9 is a highly enlarged fragmentary side elevational view of FIG. 7 showing the stripping device in greater detail in another operating phase thereof.

As is apparent from FIG. 7, the transport belt 1 carrying the substrate 2 runs between the impression cylinder 3 and a back-pressure cylinder 24. In order to break or neutralize the adhesion of the freshly printed substrate 2 to the cylinder 3, the substrate 2 is initially contacted in the marginal region of the leading edge thereof by the outermost corner 22 of the stripping device 19, as is seen in FIG. 8 and, beginning from there, is stripped from the impression cylinder 3. The cylinder 3 is formed with a recess 23 on the surface thereof and, in a preferred embodiment, the outermost corner 22 of the stripping device 19 engages in the recess 23. The leading edge of the substrate 2 , as can be seen in FIG. 9, is guided along a guide surface 20 formed on the stripping device 19, thereby avoiding any smearing of the ink of the freshly printed substrate 2. The guide surface 20 guides the substrate to an arrangement of guide rollers 21, which are disposed at a small distance above the transport belt 1. The guide rollers 21 are able to contact the surface of the substrate without thereby smearing the ink on the surface. The substrate 2 is then deposited on the transport belt 1 and is transported farther thereby. The substrate 2 may be a sheet of paper or any other printable matter, such as glass or the like, for example.

We claim:

1. A device for holding substrates on a printing-press transport belt for transporting successive substrates closely past an impression cylinder, comprising a stripping device disposed in an exit part of a nip between the impression cylinder and the transport belt, said stripping device extending substantially across the width of the impression cylinder and being of such form that a corner of a substrate adhering to the impression cylinder is initially strippable from the impression cylinder.

2. The device according to claim 1, including rollers, through the intermediary of which the substrate is guidable, after it has been stripped away from the impression cylinder by said stripping device, for supplying the substrate to the transport belt.

3. The device according to claim 1, wherein a corner of the stripping device initially stripping the substrate away from the impression cylinder engages in a groove formed on the surface of the impression cylinder.

4. The device according to claim 1, wherein said stripping device has a guide surface for guiding the stripped away leading edge of the substrate from the transport belt so that the freshly printed substrate avoids contact with said guide surface.

* * * * *

UNITED STATES PATENT AND TRADEMARK OFFICE

CERTIFICATE OF CORRECTION

PATENT NO. : 5,727,466

DATED : March 17, 1998

INVENTOR(S) : Martin Greive et al.

It is certified that error appears in the above-identified patent and that said Letters Patent is hereby corrected as shown below:

Title page, item [20] should read as follows:

Filed: Dec. 18, 1996

Signed and Sealed this

Thirteenth Day of April, 1999

*Attest:*

Q. TODD DICKINSON

*Attesting Officer*

*Acting Commissioner of Patents and Trademarks*